United States Patent [19]

Smith et al.

[11] 3,936,042

[45] Feb. 3, 1976

[54] SHEET FEEDING DEVICES

[75] Inventors: Vernon J. Smith, Tewkesbury, England; Howard M. Smith, Venray, Netherlands; Bernard F. Page, Coleford; Laurence G. Miller, Drybrook, both of England

[73] Assignee: Rank Xerox Ltd., London, England

[22] Filed: Nov. 19, 1973

[21] Appl. No.: 417,016

[52] U.S. Cl. ..... 271/9; 271/111; 271/125

[51] Int. Cl.[2] ..... B65H 1/28; B65H 3/52

[58] Field of Search ..... 271/9, 110, 111, 164, 171, 271/122, 125, 274

[56] References Cited

UNITED STATES PATENTS

| | | | |
|---|---|---|---|
| 2,036,919 | 4/1936 | Calmes | 271/125 |
| 2,903,133 | 9/1959 | Quinn et al. | 271/110 X |
| 3,525,517 | 8/1970 | Toby | 271/117 |
| 3,580,566 | 5/1971 | Vasse | 271/110 |
| 3,601,394 | 8/1971 | Lang et al. | 271/9 X |
| 3,698,706 | 10/1972 | Mihojevich et al. | 271/9 |
| 3,756,586 | 9/1973 | Craft | 271/9 |

FOREIGN PATENTS OR APPLICATIONS

| | | | |
|---|---|---|---|
| 1,167,881 | 10/1969 | United Kingdom | 271/9 |
| 1,263,340 | 5/1961 | France | 271/274 |

*Primary Examiner*—Evon C. Blunk
*Assistant Examiner*—Bruce H. Stoner, Jr.

[57] ABSTRACT

A sheet feeding mechanism for a reproduction machine has a plurality of trays for supporting sheets of various sizes which are to be fed into the machine. A baffle plate is provided for each tray for guiding the sheets from that tray upwardly to a sheet separating roller assembly associated only with that particular tray. All of the sheets from the various trays are fed to a common output.

2 Claims, 18 Drawing Figures

SHEET FEEDING DEVICES

This invention relates to sheet feeding devices.

In apparatus such as described in British Patent Specification No. 1,284,832, a copying machine receives sheets onto which copies of a document are to be transferred at an entry slot. When the copying machine is operated at high speed, it becomes impractical to feed copy sheets into the slot manually. In FIG. 20 of the earlier British Patent Specification, there is illustrated a feeding device for feeding sheets selected from stacks of sheets of different sizes into the copying machine. The present invention is concerned with an improvement of that apparatus, and can be used in the same way.

According to the invention there is provided a sheet feed device comprising a plurality of support surfaces each for supporting a stack of sheets, a sheet separating device for each support surface, a sheet forwarding device for each support surface for feeding the top sheet of the stack to the corresponding sheet separating device, a single sheet conveyor and guide means for guiding sheets from all the sheet separating devices to the single sheet conveyor.

In the earlier specification, sheet separation occurs by friction applied to the side of the stack from a pair of pressure pads, and no separate sheet separating device is provided downstream of the sheet forwarding device. Furthermore, the guides from the support surfaces for the stacks which lead to a common sheet feed path lead to a series of widely spaced grippers on a chain, so that the feeding of sheets from the support surfaces must be carefully synchronised with the movement of the chain so that the sheets can be conveyed out of the sheet feed device by the chain grippers. In one arrangement of the present invention, the sheet conveyor comprises a pair of pinch rolls which, when driven will convey a sheet onwards whenever it arrives at the pinch rolls.

In the drawings, which show an example of the invention,

Figure 1:
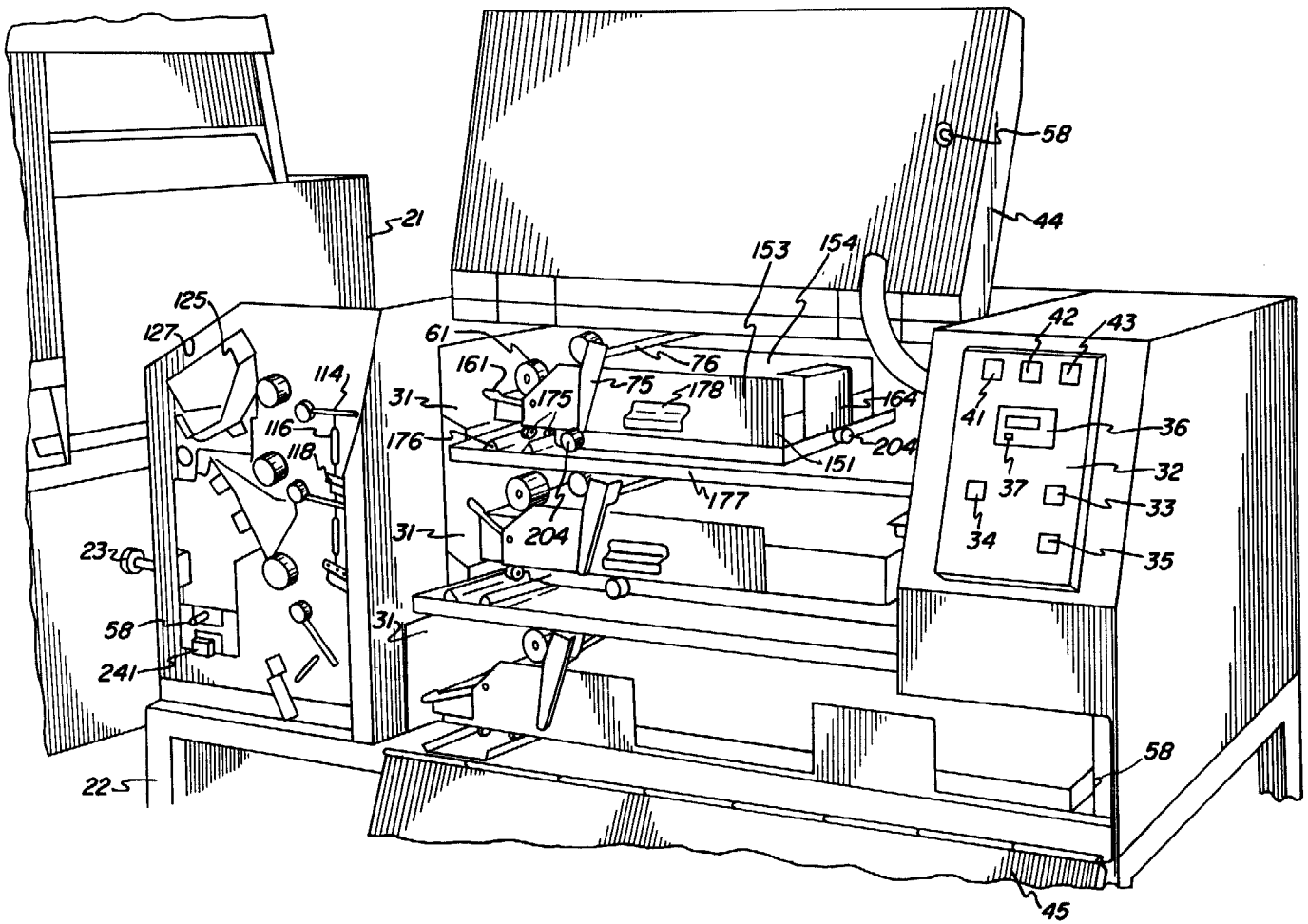
FIG. 1 is a perspective view of a sheet feed apparatus with some parts of its cabinet removed and some cabinet doors open.

The sheet feeding apparatus shown in the drawings is intended for feeding cut sheets of different sizes into a main copying machine 21, which forms xerographic images of an original on the sheets. The apparatus is mounted on a wheeled frame 22 and is provided with buffers 23 which keep the apparatus from approaching the main copying machine too closely. A docking clamp and electrical connector (not shown) are provided between the apparatus and the main copying machine.

The central portion of the apparatus as seen in FIG. 1 contains three compartments 31, supporting paper trays 151 for three sizes of sheet. On the right hand side of the apparatus, there is a control and indicator panel 32, containing an "ON" button 33 with an associated indicator lamp 34, an "OFF" button 35, a meter 36 to show the number of sheets fed with a reset button 37 and three indicator lamps 41, 42, 43 denoted "Register Tray" "Paper Jam" and "Add Paper" respectively.

Figure 2:
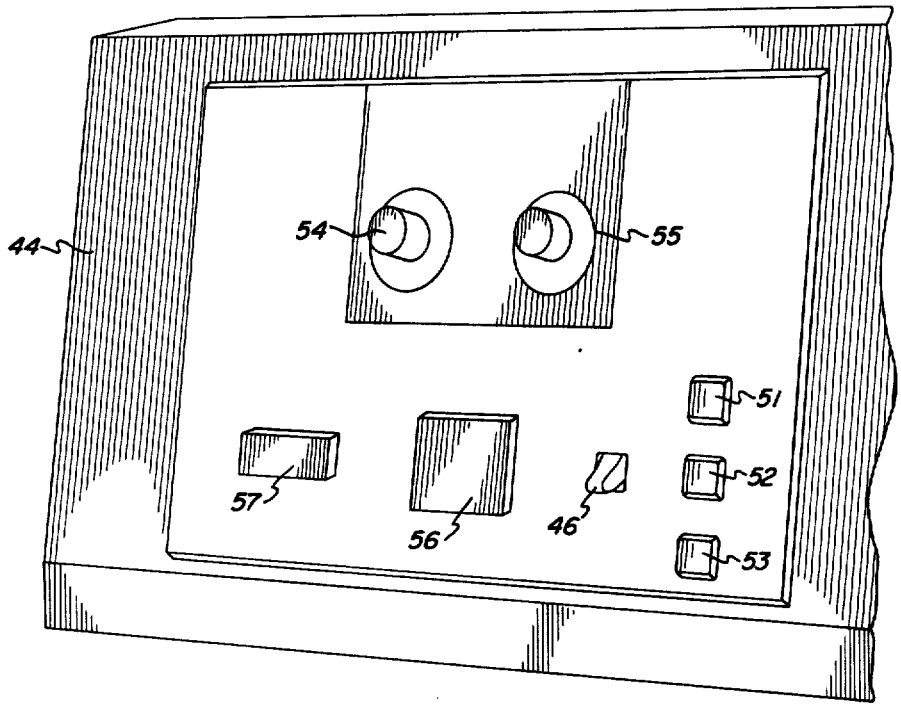
FIG. 2 shows a control panel hidden in FIG. 1.
Figure 7:
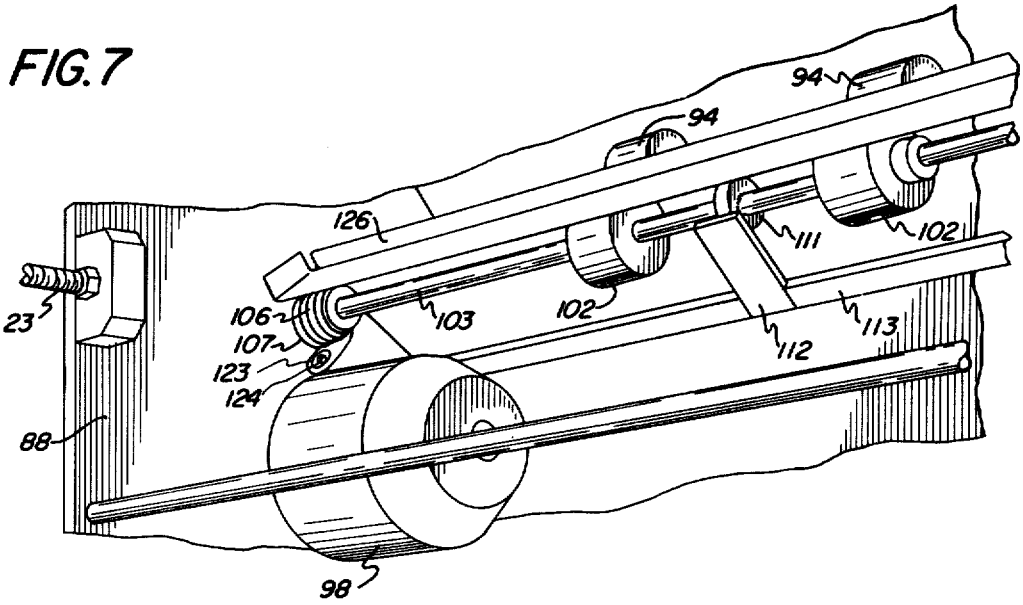
FIG. 7 is a perspective view of part of the apparatus of FIG. 3, with certain components removed for clarity.

The apparatus cabinet has three doors. One door not shown provides access to the left hand portion of the apparatus, and access is provided to the compartments 31 by two doors 44, 45 on horizontal hinges. The lower door 45 opens downwards in front of the lower compartment, and the upper door 44 opens upwards in front of the upper two compartments. On the front of the top cabinet door 44 there are further dials and switches shown in FIG. 2. (The top door 44 is shown open in FIG. 1 so that the dials and switches are not visible in that figure). There is a three-way switch 46 for selecting one of the compartments 31 for use, and three panel lights 51, 52, 53 indicate the compartment selected. The switch 46 selectively connects alarms (to be described later) in the compartments to the lamps 41–43 described above and to a machine shut-down mechanism so that only an undesired event in the selected compartment will be indicated and will cause the machine to shut down. On the front of the top door 44 there are also two dials 54, 55 for setting the digits of the number of sheets to be fed (maximum 99), and buttons 56, 57 to start and stop the feeding operation and the subsequent printing operation in the main copying machine 21.

Interlock switches 58 are mounted adjacent the doors 44, 45 and are connected in the electrical supply to the apparatus so that the apparatus cannot be operated while any of the doors is open.

Inside the top of each paper tray compartment 31, there is provided a feed roller assembly. Each assembly comprises a pair of feed rollers 61 mounted on a shaft 62. This shaft is supported at the end of a hollow arm 63, whose other end is supported on an upper shaft 64 adjacent the roof of the compartment. The torque tube 65 is connected to the hollow arm and extends around said upper shaft from the arm towards the rear of the compartment. A lever 66 extends from the torque tube in the opposite direction to the hollow tube, and this lever is formed with two recesses 67, 68, whose function is described below.

Figure 8:
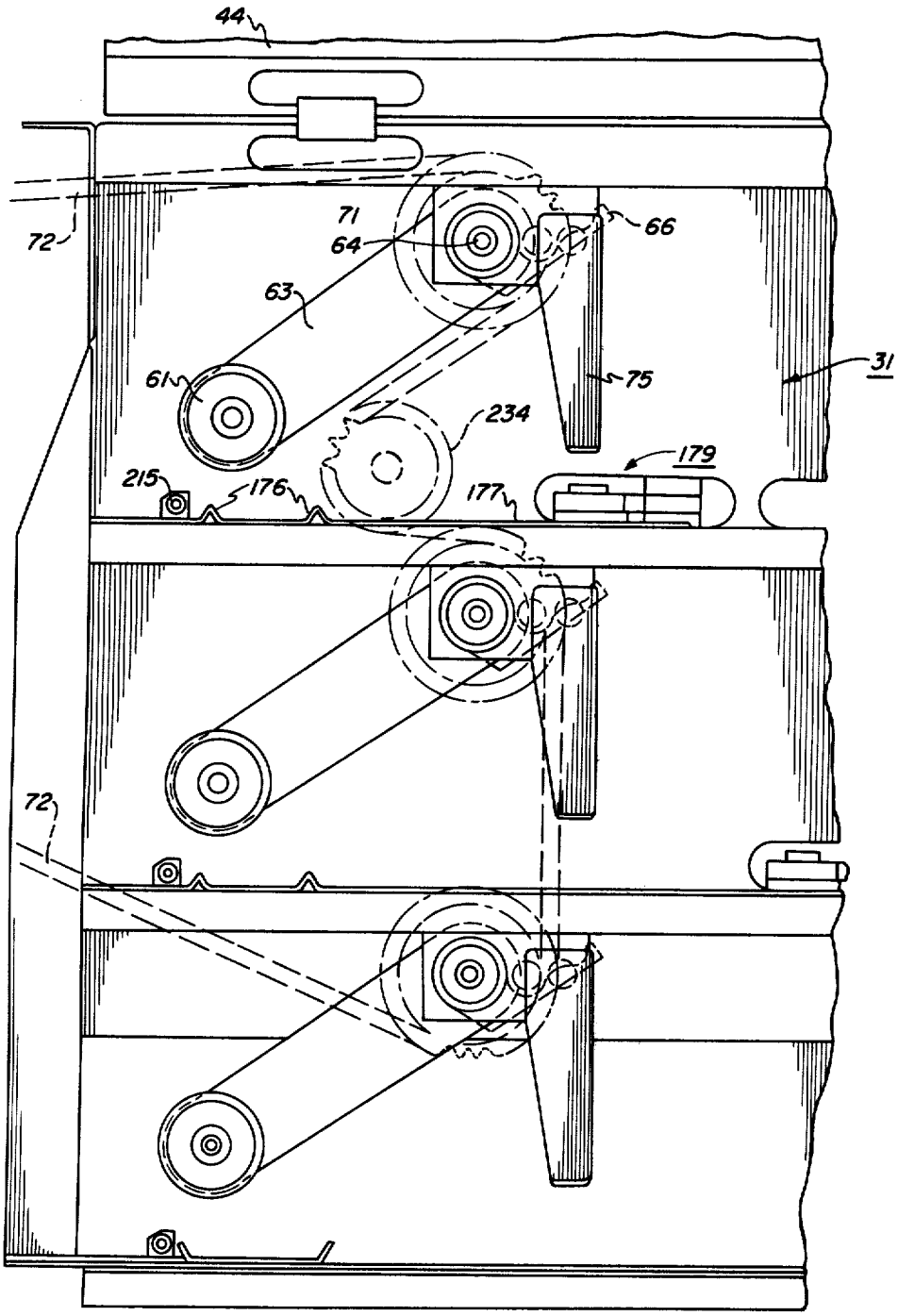
FIG. 8 is a side elevation of part of the right hand portion of the apparatus of FIG. 1, and FIGS. 8A – 8C are schematic illustrations of the detail of FIG. 8 in various positions.

The upper shaft 64 is driven on a sprocket 71 driven by a main drive chain 72 of the apparatus through an electromagnetic clutch 73 controlled by the machine logic. The upper shaft 64 drives the feed rollers 61 by means of a belt and pulley drive (not visible) within the hollow arm 63. The feed rollers 61 are provided with overrunning clutches 74 to allow them to rotate in the clockwise direction as seen in FIG. 8 relative to the shaft 62.

Figure 8A:
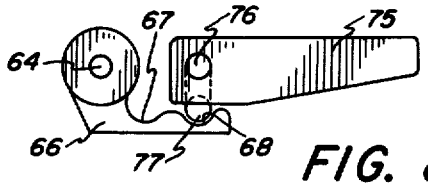
Figure 8B:
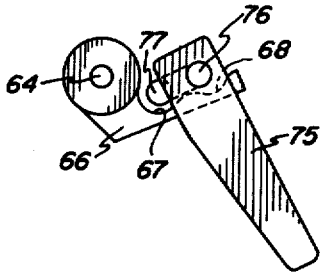
Figure 8C:
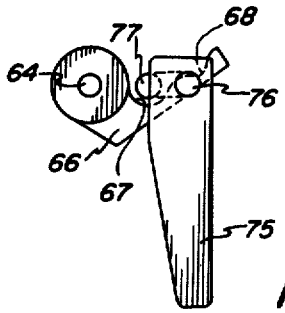

At the front of the compartment, there is provided a handle 75 mounted on a shaft 76 parallel and adjacent to said upper shaft 64, and provided at its rear end with a crank 77 which engages the recesses 67, 68 in the lever 66 mounted on the torque tube 65. When the handle 75 is in the downward vertical position as shown in FIGS. 8 and 8C, the crank 77 is disengaged from the recesses 67, 68 in the lever 66 and the feed rollers 61 are free to drop towards the floor of the compartment as the hollow arm 63 rotates about the upper shaft 64. When it is required to remove the paper tray 101 from its compartment, the handle is moved to a horizontal position anti-clockwise in FIG. 8. As the handle 75 is moved, the crank 77 engages the recess 67 nearer the upper shaft 64, depressing the lever 66 and thus raising the feed rollers 61 towards the roof of the compartment. As the handle 75 and the hollow arm 63 approach the horizontal position, the crank 77 moves from the first recess 67 on the left hand side of the handle shaft 76 (FIG. 8B) to the second recess 68 on the right hand side of the handle shaft 76 (FIG. 8A) so that the weight of the feed rollers now presses the handle 75 upwards against a stop not shown so that the feed rollers 61 and the handle 75 will remain in the horizontal positions until the handle 75 is depressed to move the crank 77 back into the left hand recess 67 when the feed rollers 61 are again lowered under the control of the handle 75.

A second electromagnetic clutch 78, which acts as a lift clutch, is provided between the drive shaft 64 and the torque tube 65. The clutch 78 has its body 81 secured to the shaft 64, and its armature 82 secured to the torque tube 65 by means of couplings 83, so that the feed rollers 61 can be removed from the apparatus easily. An overrunning clutch 84 mounted on the shaft 64 connected to a lift arm 85 pivoted for movement about the shaft 64. The free end of the arm 85 is secured to a lift solenoid 86. On energisation of the solenoid 86, the lift arm is rotated about the shaft 64 to cause the overrunning clutch to lock so that a predetermined small angle of rotation is applied to the shaft 64.

The machine logic is arranged to energise the solenoid 86 and the lift clutch 78 together when the electromagnetic clutch 73 is de-energised. This arrangement ensures that the small angle of rotation is applied to the shaft 64 by means of the solenoid 86, the lift arm 85 and the clutch 84, and the same angle of rotation is applied to the torque tube 65 through the clutch 78. This arrangement provides that the feed rollers are lifted by a small predetermined amount whatever their position relative to the shaft 64, and are allowed to drop back by the small predetermined amount when the clutch 78 and the solenoid 86 are de-energised. With this arrangement, the chance of the feed rollers 61 disturbing the sheets of paper below them as they descend is reduced.

Figure 3:
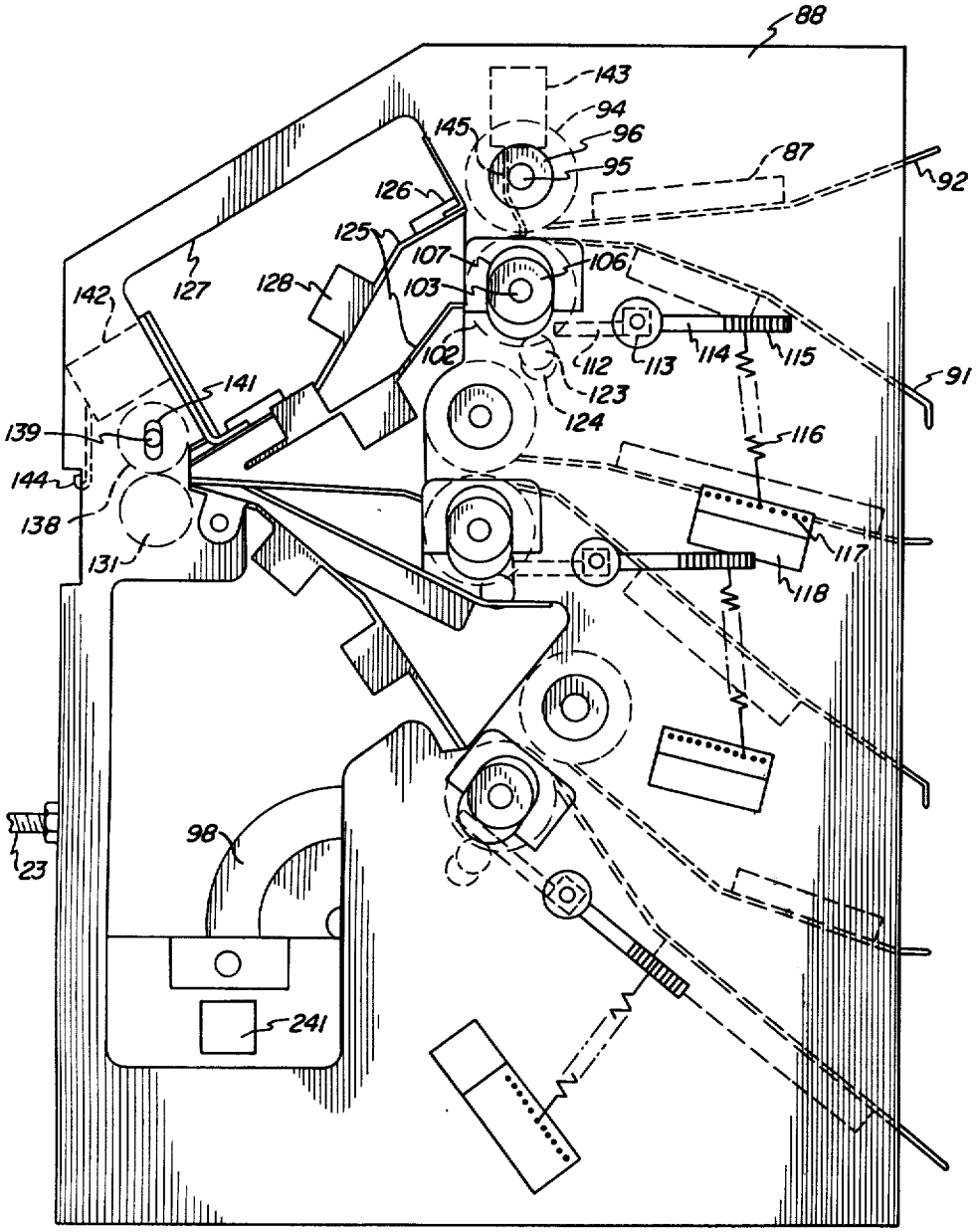
FIG. 3 is a side elevation of the left hand portion of the apparatus of FIG. 1.
Figure 4:
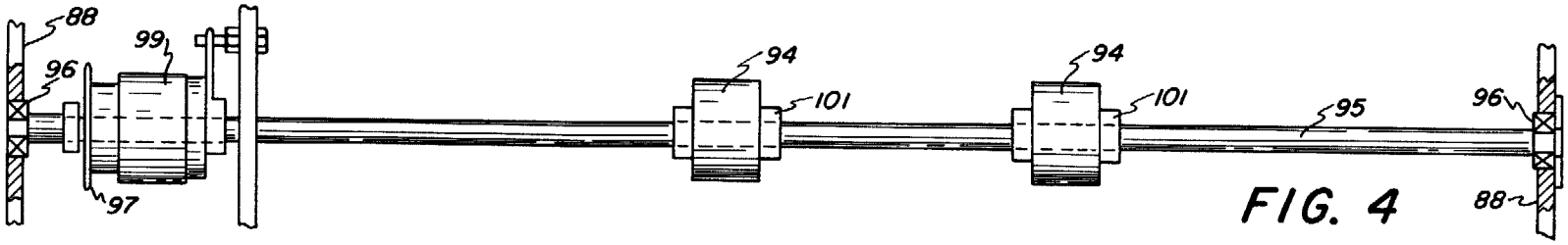
FIG. 4 is a side elevation of a shaft from FIG. 3, showing the components mounted upon it.
Figure 5:
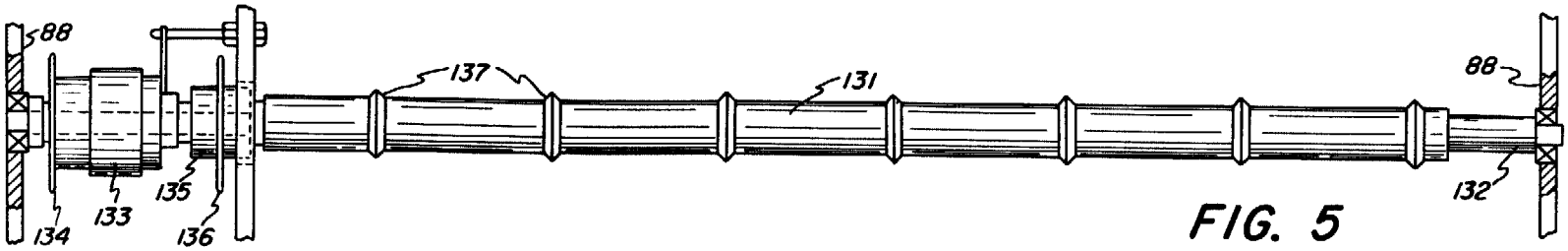
FIG. 5 is a side elevation of another shaft from FIG. 3, showing the components mounted upon it.
Figure 6:
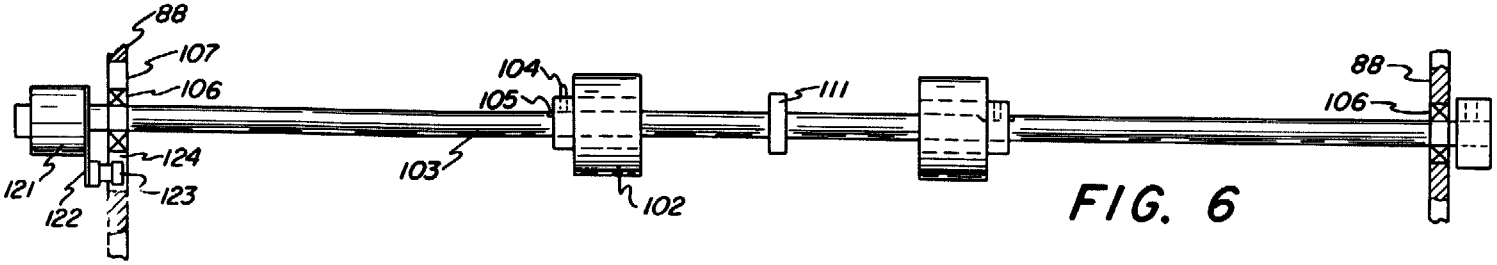
FIG. 6 is a side elevation of a further shaft from FIG. 3, showing the components mounted upon it.

The selected feed roller assembly feeds sheets into the corresponding sheet feed path as shown in FIG. 3, commencing on the right hand side of the figure and ending at a common point for all three paths on the left hand side of the figure. The three paths corresponding to the three compartments 31 resemble each other, and only one will be described. The start of each path is formed by two baffle plates 91 and 92, whose spacing becomes progressively smaller as the distance from the right hand side of the figure increases. The baffle plates are formed with plane sections which are inclined to each other. All the sections of the lower plate 91 are upwardly inclined in the direction of sheet travel and the sheet from the compartment will strike the lower plate 91 and be guided upwardly along the path by the lower plate 91. The baffle plates are fixed by means of brackets 87 to the side plates 88 of the apparatus.

The left hand end (as seen in FIG. 3) of each pair of baffle plates 91 and 92 feeds into the nip of a separator roller assembly. The assembly comprises two pairs of knurled polyurethane surfaced rollers for high coefficient of friction, the upper roller 94 of each pair being mounted on a shaft 95 journalled in fixed bearings 96 in the side plates of the apparatus. The shaft 95 is driven from a sprocket 97 engaging the common drive chain 72 (FIG. 8) driven by a main drive motor 9B through an electromagnetic clutch 99 controlled by the machine logic. The connection of the motor 98 to the chain 72 will be described later. The rollers 94 are driven in the clockwise direction seen in FIG. 3 by the shaft 95, but are provided with overrunning clutches 101 so that they can rotate clockwise as seen in FIG. 3, relative to the shaft. Over-running will occur when a sheet is pulled out faster than the rollers 94 are being driven.

The lower rollers 102 of the two pairs in the separator roller assembly are mounted opposite the respective upper roller on a shaft 103 for rotation therewith by a screw 104 engaging a recess 105 in the shaft 103. The shaft 103 is journalled in bearings 106 mounted in slots 107 in the side plates of the apparatus, the slots being elongated along the line joining the two shafts 95, 103. The lower shaft 103 can therefore move towards and away from the upper shaft 95, but cannot move in the tangential direction. It can also move out of parallel to the shaft 95 if a different thickness of sheet appears between the two pairs of rollers or if the rollers 94 should be non-concentric with the shaft 95.

The lower roller shaft 103 is biased towards the upper roller shaft 95 by a biasing system acting on a ball race 111 at the centre of the lower shaft. The rollers 102 are equidistant from the ball race 111. The biasing system comprises a lever 112 extending from a square-section shaft 113 journalled in the side plates of the apparatus, a second lever 114 extending from the end of said shaft oppositely to the lever 112 and outside the side plate 88. The lever 114 is provided with a series of annular recesses 115 along its length, and a spring 116 extends from one of the recesses to one of a series of holes 117 on a bracket 118 mounted on the outside of the side plate 88. The appropriate recess 115 and hole 117 are chosen for securing the ends of the spring 116 in order to provide a desired bias to the lower shaft 103.

The lower shaft 103 of the separator roller pair is anchored to the side plate 88 through a mechanical slip clutch 121. A frame anchor is provided by a plate 122 keyed to the clutch 121 and carrying an auxiliary roller 123 movable in a narrow slot 124 extending from the lower end of the slot 107 in the side plate in which the bearings 106 of the lower shaft 103 move. The achoring roller 123 can therefore move towards and away from the upper shaft 95 with the lower shaft 103, but prevents the plate 122 from rotating relative to the side plate 88. The mechanical slip clutch 121 is set to slip at a predetermined torque.

In an alternative arrangement not shown, an electrical slip clutch is provided, which will slip at a torque determined by the current applied to the clutch. Adjustment of this clutch is by changing the current supplied to it, whereas adjustment of a mechanical slip clutch will require physical access of at least a tool to the slip clutch, which is often not possible in a compact machine without disassembly of several components. A sensing device (not illustrated), such as a microswitch, can be provided to operate the "paper jam" alarm and shut down the machine if the shaft 103 is moved by an excessive amount away from the upper shaft 95, as when a very large number of sheets are fed simultaneously between the rollers 94, 102 which might not be properly separated by the separator roller assembly.

On the left hand side of the separator roller sets (as seen in FIG. 3), further baffle plates 125 are provided with guide sheets from the three separator roller assemblies to a common drive roller assembly. The additional baffle plates 125 are slidably mounted on rails 126 secured between the side plates 88, and can be withdrawn through an aperture 127 in the side plate by means of lugs 128 in order to clear a paper jam. The upper and lower baffle plates are slidably mounted at each side, but the central baffle plates are mounted on rails at their right hand ends only, as the sheet paths merge at their left hand ends and mounting rails would obstruct these paths. Instead the left hand ends of the baffles 125 are supported at their front and rear edges on brackets (not shown).

The lower roll 131 of the drive roll assembly is mounted on a shaft 132 journalled as fixed positions in the side plates 88 of the apparatus. The shaft 132 is driven through an electromagnetic clutch 133 from a sprocket 134 driven by the common drive system of the apparatus, and a mechanical overrunning clutch 135 is also mounted on the shaft 132 driven by a sprocket 136 of a slower speed drive system. The roll 131 is provided with a number of resilient bands 137 along its length in order to increase the driving power of the roller. The upper roll 138 of the assembly is mounted on a shaft 139 supported in vertically extending slots 141 in the side plates 88 above the drive roll 131 and is of metal with a smooth surface. The roll 138 presses down on to the bands 137 so that any sheet therebetween will be driven forward when the roll 131 is rotated. The weight of the roll 138 biases it towards the drive roll 131.

Two microswitches 142, 143 sense the passage of sheets through the apparatus of FIG. 3. An actuating arm 144 of the first microswitch 142 is located in the path of sheets emerging from the drive roller assembly. The second microswitch is located with its actuating arm 145 adjacent the exit from the top set of separating rollers only. Both microswitches are connected into the machine logic. The microswitch 142 on actuation causes the machine logic to de-energize the electromagnetic clutches 73, 99 of the separator roller assembly and feed rollers which had previously been energised. The microswitch 143 when actuated causes the machine logic to de-energize the electromagnetic clutch 73 in the drive to the feed rollers in the upper compartment only. The microswitch 143 is provided in the upper sheet feed path only, as this path is intended for short sheets whose trailing edge will have left the feed rollers 61 before the leading edge reaches the actuating arm 144 of microswitch 142. The microswitch 143 on actuation also causes the machine logic to energise the lift clutch 78 and energise the solenoid 86 so that the feed rollers 61 are lifted from the paper stack. This avoids overloading the separator roller 94 by the drag of the overrunning feed rollers 61 if they had been left in contact with the top sheet being fed after de-energisation of the clutch 73.

Figure 15:
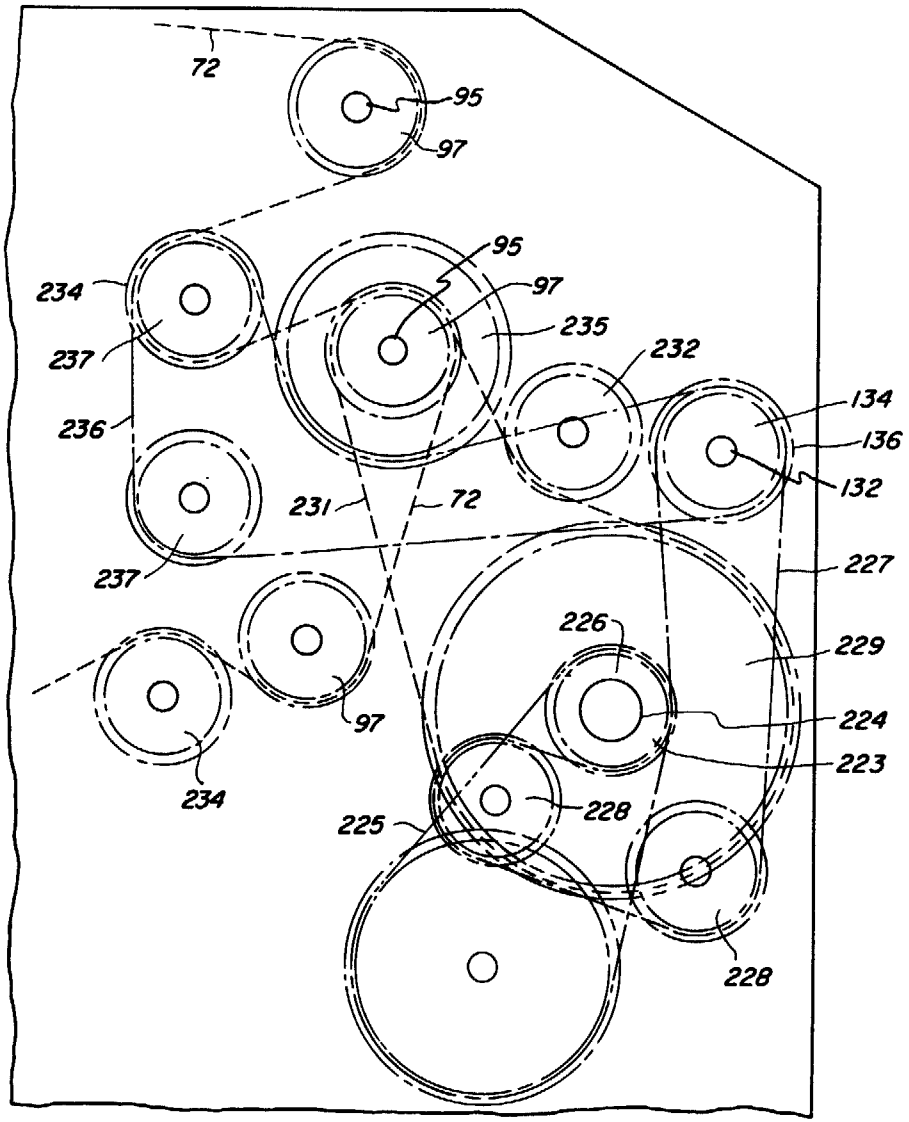
FIG. 15 shows the chain drives of the apparatus.
Figure 15:
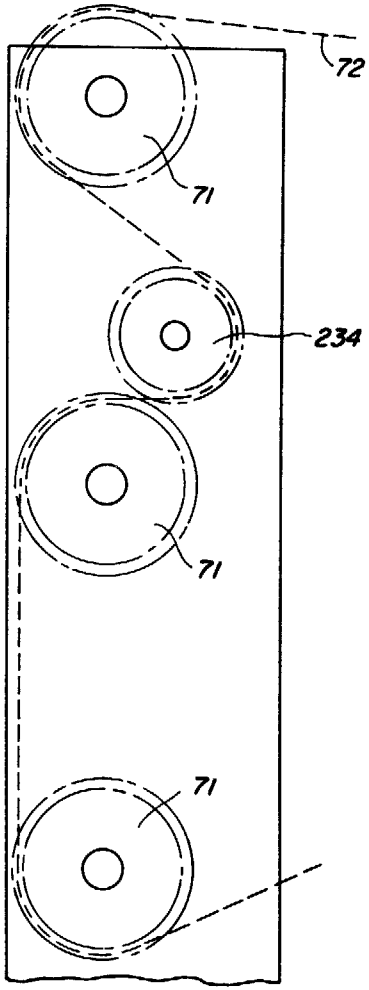

Referring to FIG. 15, the drive to the electromagnetic clutches 73, 99 and 133 for the feed rollers, separator rollers, and drive roll originates from the motor 98. A sprocket 221 mounted on the output shaft 222 of the motor 98 and drives a first sprocket 223 on a layshaft 224 by means of a chain 225. A second sprocket 226 on the layshaft 224 drives a chain 227 over two idler sprockets 228 and the sprocket 136 connected to the mechanical overrunning clutch of the drive roller shaft 132. A third sprocket 229 on the layshaft 224 drives the sprocket 97 on the separator roller shaft 95 for the central sheet feed path through a chain 231 which passes over an idler sprocket 232 located on the outside of the chain 231 as seen in FIG. 15. This shaft 95 drives other chains for other parts of the apparatus. A second sprocket 233 on the central separator roller shaft 95 drives the chain 72 which passes over sprockets 71, 97 driving the electromagnetic clutches of the three separator roller shafts, and of the three feed roller shafts. Idler sprockets 234 between the upper and middle sprockets 71 and 97 and below the lower sprockets 71 and 97 ensure that the chain 72 wraps over a sufficient fraction of the periphery of the sprockets of the central and lower shafts. A third sprocket 235 on the central separator roller shaft drives a chain 236 passing over two idler sprockets 237 and the sprocket 134 connected to the electromagnetic clutch 133 on the drive roller assembly. The chain 236 drives the drive roller shaft 132 at a higher speed when energised, and the chain 227 otherwise drives it at a lower speed.

Figure 12:
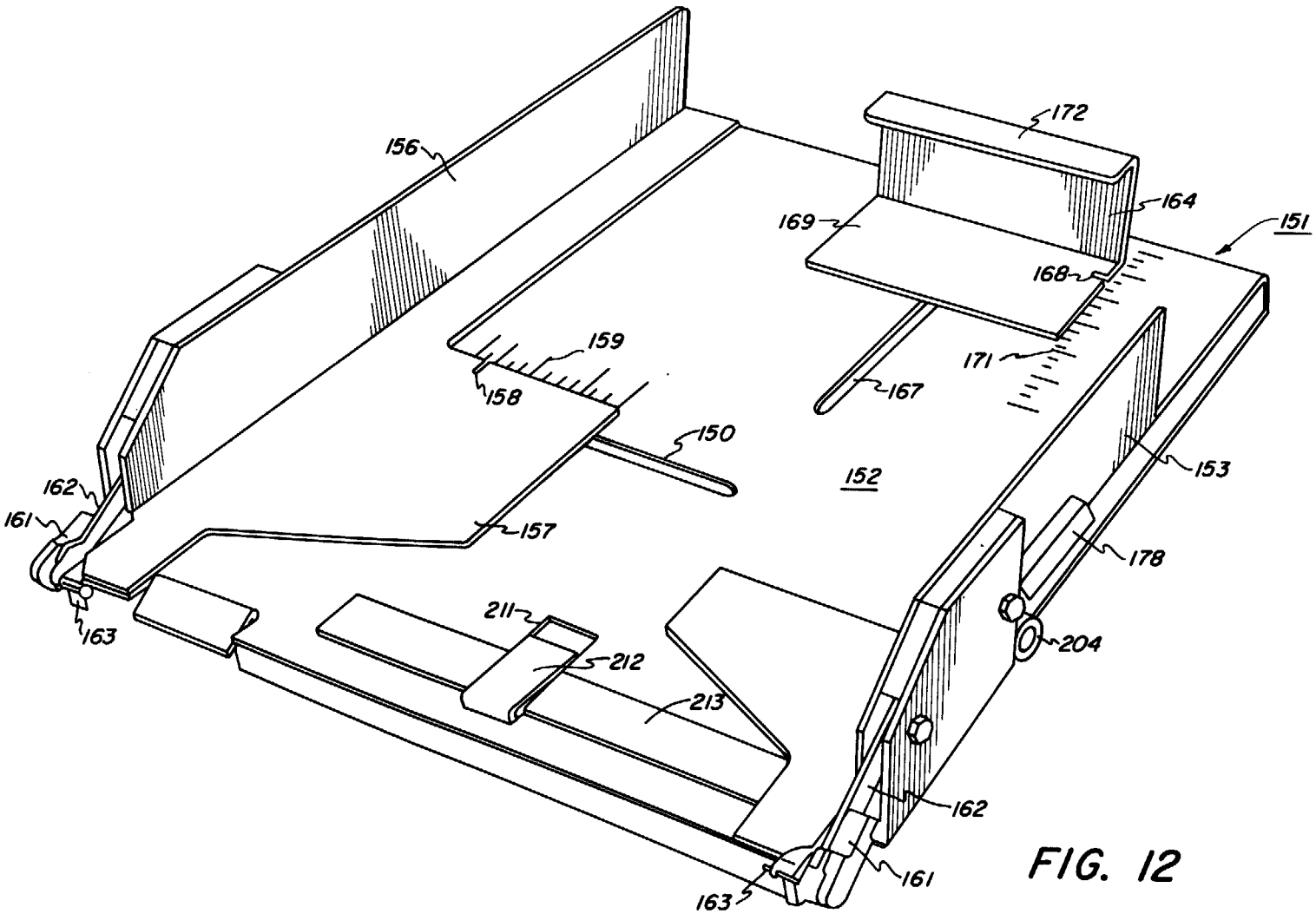
FIGS. 12 and 13 are perspective views of a paper tray for use in the apparatus illustrated.
Figure 13:
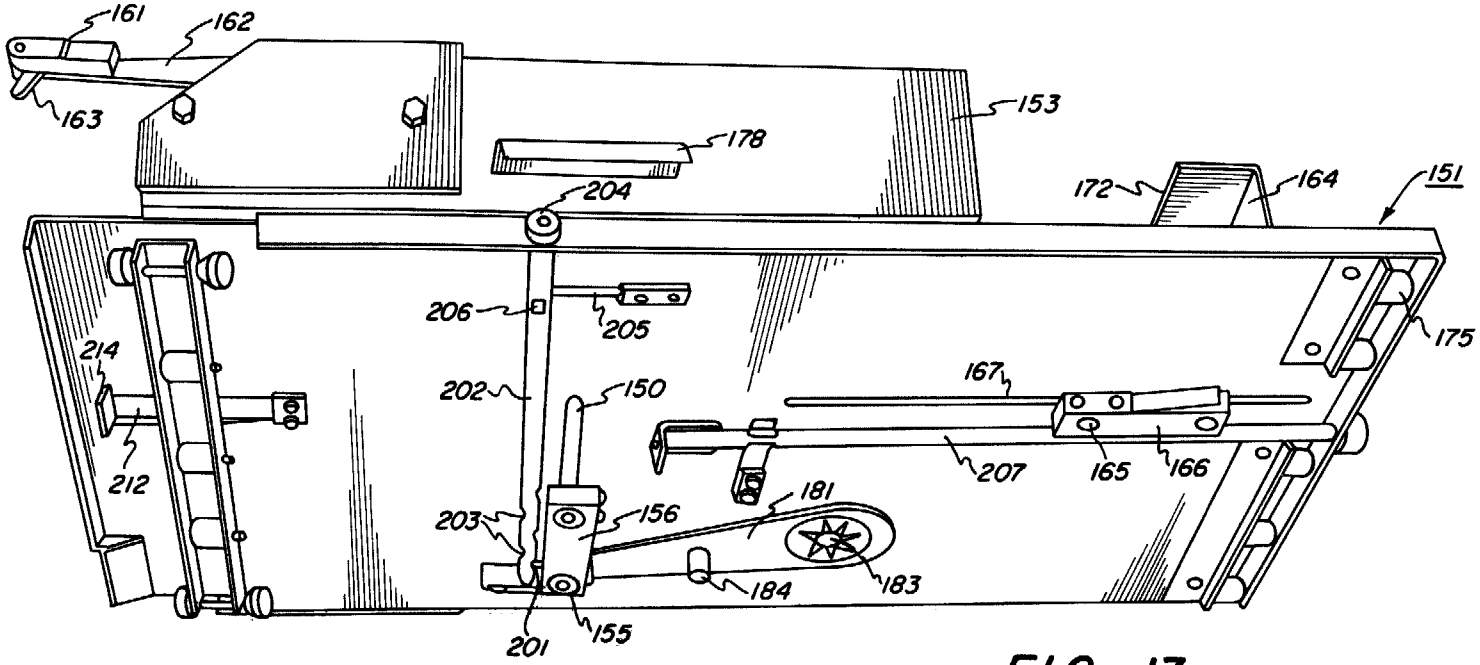

Referring to FIGS. 12 and 13, each paper tray 151 comprises a base plate 152, with a front margin guide 153 which is fixed to the base plate. The rear margin guide 154 is movable relative to the base plate, and is mounted on two pins 155 passing through a slot 150 in the base and attached to a block 156 below the base plate. The rear edge margin guide 154 is provided with a plate 157 which extends partially over the base, which together with the pins 155 and the block 156 provide a firm mounting for the rear edge margin guide on the base plate. The plate 157 is provided with an index 158 which moves relative to a scale 159 on the base plate 152 to indicate the separation of the rear guide 154 from the front guide 153.

There is no left hand margin guide, as sheets are to be fed off the stack to the left. However, the front and rear edge margin guides are provided with snubbers 161 at the left hand end of the tray. The snubbers are mounted on arms 162 pivotally mounted on the guides and having small brackets 163 of wire pivotally mounted on shafts 160 for engaging the two top left hand corners of the stack of sheets supported on the tray on the top and left hand surfaces of the stack. Springs (not shown) bias the brackets 163 to the position shown in FIG. 12 relative to the arms 162. The snubbers 161 obstruct the passage of the top sheet of the stack as it is fed to the left, causing the sheet to buckle in order to pass thus facilitating the separation of the top sheet of the stack from the remaining sheets. As the top level of the stack descends, the snubbers 161 will descend accordingly, as their supporting arms 162 pivot about the front and rear guides of the tray. When a new stack of paper is placed on the tray, the snubber arms 162 are pulled up on to the top of the stack, the snubber brackets 163 pivoting forwardly on their shafts 160 as the brackets are pulled through the stack and springing back to the position illustrated in FIG. 12 when they clear the top of the stack. The snubbers then rest in the top of the stack as described above.

A right hand margin guide 164 is provided on the base plate mounted by means of two pins 165 and a block 166 for movement along a further slot 167, similarly to the mounting of the rear edge margin guide 154. The right hand guide 164 is provided with an index 168 on its plate 169 adjacent a scale 171 marked on the bases of the tray indicating the distance of the right hand edge of the stack from the snubbers 161. The right hand edge margin guide is provided with an overhanding lug 172 at its upper end to prevent an excessive height of stack being placed on the tray which might prevent the feed rollers 61 from working satisfactorily.

On the underside of the tray, there are two rows of rollers 175, mounted on axes extending parallel to the front and rear edge margin guides 153, 154. The left hand row of rollers co-operate with rails 176 formed on the floor 177 of the compartments 31, and the right hand rollers rest on the floor of the compartments, so that the tray 151 can be rolled into and out of the compartment 31. The direction of movement of the tray is at right angles to the direction of the paper feed. The front margin guide is provided with a handle 178 on the outside for use when moving the tray in the compartment.

Figure 10:
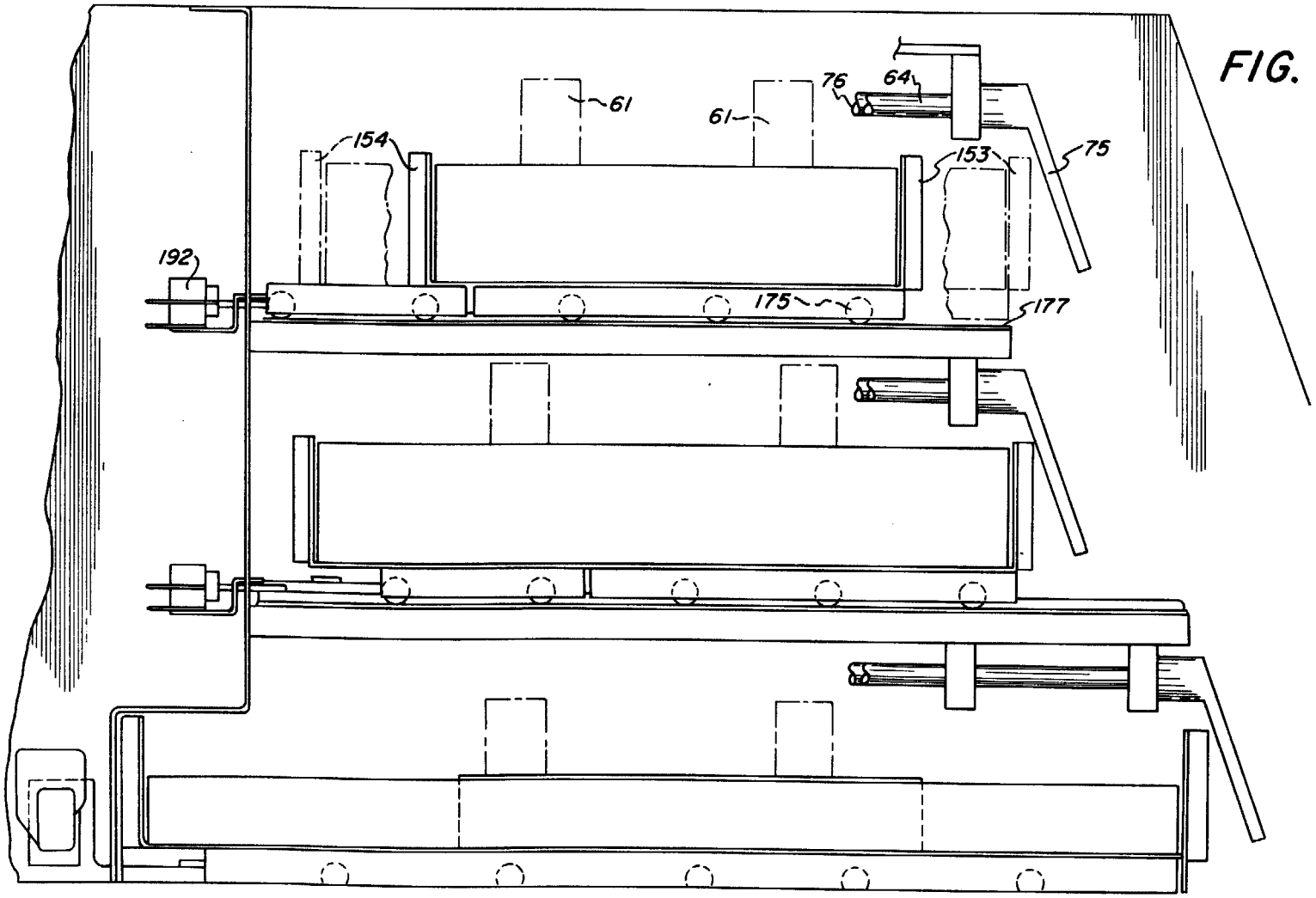
FIG. 10 is a schematic end elevation from the same position as FIG. 9 but showing paper trays in position.
Figure 11:
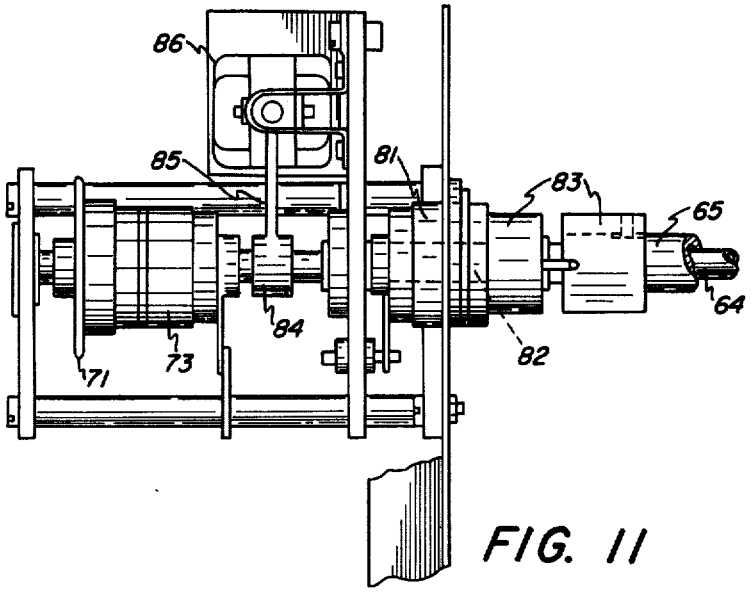
FIG. 11 is a plan of a detail of FIG. 9.

Since it is important that the sheets in the tray are fed forward without skewing along the centre line of the apparatus illustrated in FIG. 1, the tray 151 should be located such that the centre line of the sheets in the tray are located on a fixed line in the machine, whatever the position of the rear guide 154 of the tray. FIG. 10 shows in the top compartment 31 in full lines the position of the tray for narrow sheets of paper and in chain dotted lines the position of the tray for wider sheets of paper. It will be seen that the position of the front guide 153 and base 152 of the tray is different for the two widths of paper, and a locating device 179 is provided for automatic location of the tray in its correct position, according to the relative position of the rear side of the tray.

Figure 14:
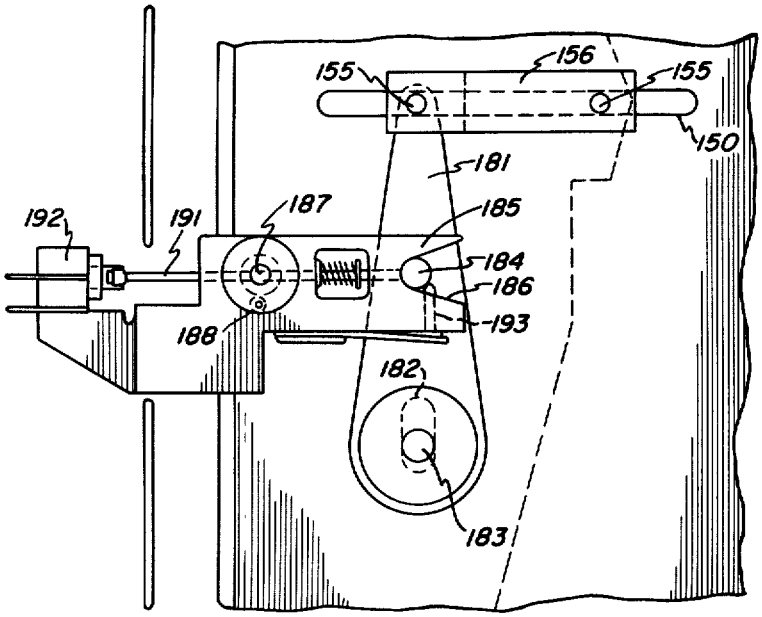
FIG. 14 is an underplan view of a detail of the apparatus.

On the underside of the tray, a link arm 181 is pivoted to the block 156 about one pin 155 at one end, and is provided with a longitudinal slot 182 at the other end through which extends a pivot pin 183 mounted on the underside of the tray. A lug 184 extends downwards from the link at a point equidistant from the mid point of the slot 182 in the arm, and from the pin 155 on the block 156. As the rear guide 154 of the tray moves relative to the remainder of the tray by a certain distance, the lug 184 will therefore move by substantially half this distance, so that the lug 184 will remain at a fixed distance from a line equidistant from the front and rear margin guides 153, 154. The lug 184 is located at a fixed position relative to the remainder of the apparatus in order to locate the tray 151 in the required position by engagement with the device 179 which comprises a lever formed with a recess 186 and mounted at the central rear portion of the compartment floor. As can be seen in FIG. 14, the lever 185 is mounted for limited rotation about a pin 187, the rotation being limited by means of a stop pin 188 extending through an enlarged hole in the lever 185. This limited rotation accomodates some sideways movement of the trays 151 in their rails 176.

At the base of the recess 186, there is provided a spring loaded plunger 191 engaging a microswitch 192 connected to the machine logic. At the side of the recess there is provided a spring latch 193 which biases the lug 184 to remain within the recess 186 after entry.

The block 156 is provided with a spring located lug 201 extending from one side, which is adapted to engage a register bar 202 located on the underside of the paper tray 151. The register bar 202 is generally cylindrical, having two series of recesses 203, extending parallel to the axis of the bar along two opposed sides of the bar. The recesses merge smoothly into the cylindrical surface of the bar in the direction transverse to the axis of the bar. The recesses 203 are located to engage the spring loaded lug 201 of the block 156 at positions corresponding to the separation of the front and rear guides of the tray to accomodate standard size widths. One line of recesses is provided appropriate to English sizes, and the other line appropriate to metric sizes.

The register bar 202 is rotatable by means of a handle 204 on the front of the tray (see FIG. 12). A leaf spring 205 mounted on the under side of the tray engages a short square section portion 206 of the register bar 202 in order releasably to retain the bar in any one of four symetrically spaced positions, two opposed positions corresponding to the alignment of the two lines of recesses with the spring loaded lug 201. Symbols M and E are marked on the tray adjacent the handle, the appropriate one of which will be opposite a marker on the handle 204 when the corresponding series of metric or English size recesses 203 is located in line with the spring loaded plunger 191.

When it is required to adjust the position of the rear side 154 of the tray, the handle 204 is rotated through 90° so that the spring loaded plunger 201 is ejected from a recess 203 by sliding up the boundary of the recess which merges smoothly into the generally cylindrical surface of the bar 202. The rear guide 154 of the tray is then moved to approximately the newly required position, the lug sliding along the cylindrical surface of the bar, after which the register bar 202 is turned so that the symbol on the handle is opposite the M or E on the tray. This rotation of the bar 202 will bring the appropriate set of recesses 203 into line with the spring loaded lug 201. The rear guide 154 is now moved further towards its required position, at which the spring loaded lug 201 will spring into the appropriate recess 203. This arrangement has the advantage that the separation of the front and rear guides 153, 154 of the tray is controlled, and (unless the operator homes in on the wrong recess) the stack of sheets in the tray cannot be left too loosely or too tightly in the tray, either of which conditions would adversely effect the accuracy of feeding of the sheets.

A similar register bar 207 is provided to control the location of the block of the right hand end guide. The guides can be located at other positions by leaving the bar 202 or 207 with its cylindrical surface opposite the lug 201, but in this case the accuracy of location is left to the operator who must line up the index 158 or 168 with the scale 159 or 171.

At the left hand edge of the tray, approximately in the centre, there is provided an elongated slot 211 at the inner end of which is mounted a leaf spring 212 on the underside of the tray. A pad 213 of high friction material is provided on either side of the slot 211 on the upper surface of the base plate 152. The normal position of the leaf spring 212 is extending through the slot 211 slightly above the upper surface of the base plate 152. However, when sheets are present on the base plate 152, the leaf spring 212 is depressed below the surface, being prevented from rising to its normal position by the weight of the sheets and the tension in the sheets which are pressed onto the floor of the tray by means of the two spaced feed rollers 61 and prevented by the friction between the rollers the sheets and the pad 213 from slipping under the feed rollers.

Figure 9:
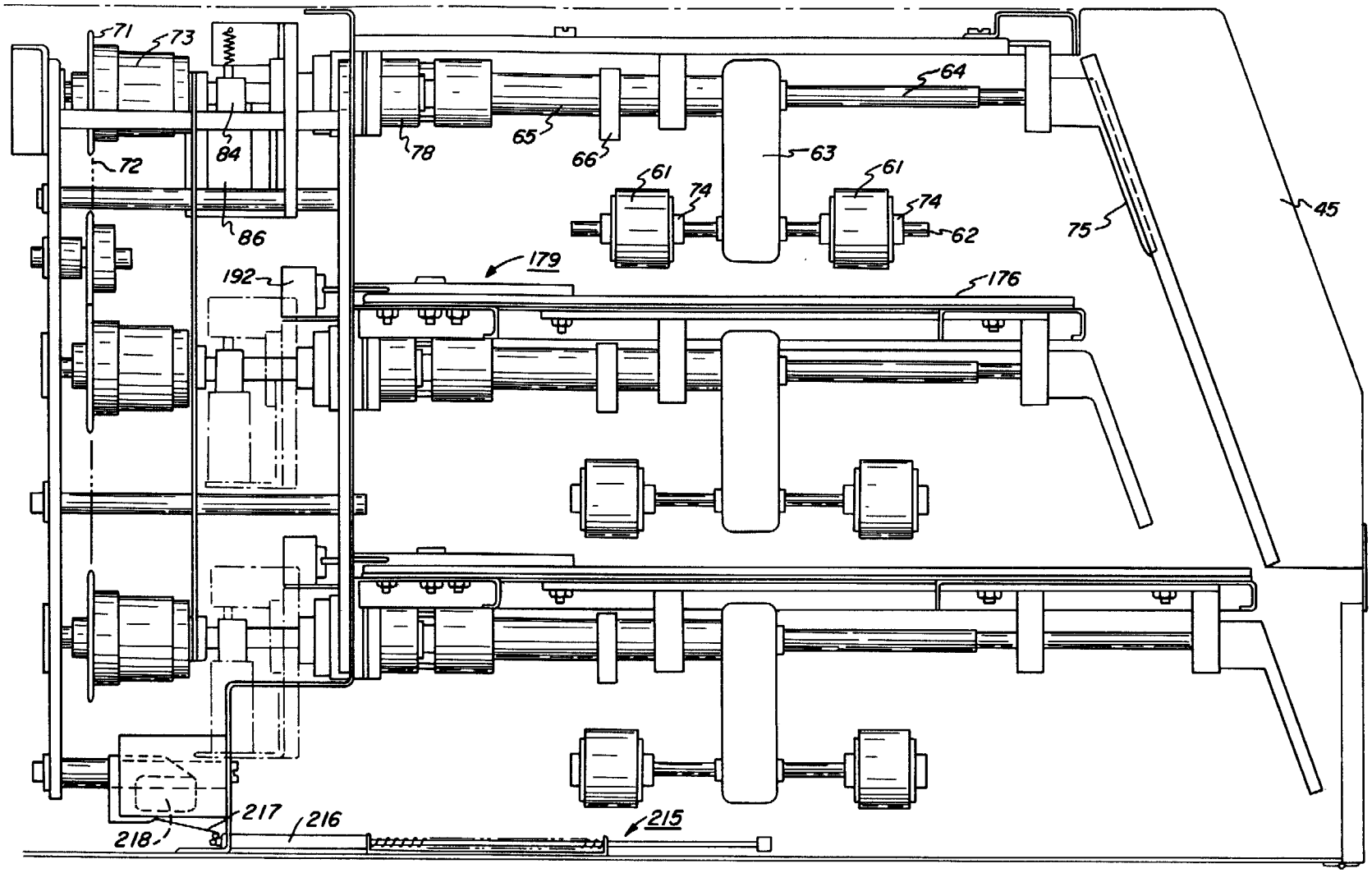
FIG. 9 is an end elevation of the apparatus of FIG. 7.

The free end of the leaf spring 212 is provided with a shoe 214 which engages, in the depressed position of the spring 212, a spring plunger 215 mounted on the floor of the compartment adjacent the left hand rail 176. The rear end of the plunger 215 is provided with an elongated portion 216 which is adapted to engage the actuating arm 217 of a microswitch 218 connected to the machine logic. When any sheets remain on the paper tray with the feed rollers resting on them, the leaf spring 212 is depressed so that the spring loaded plunger 215 is retained in a position to the left of its fully extended position as shown in FIG. 9. As the last sheet is fed from the tray, the leaf spring 212 rises to its normal position and the shoe 214 releases the spring loaded plunger 215 so that its elongated portion 216 releases the actuating finger 217 of the microswitch 218. The actuation of the microswitch causes the machine logic to indicate that paper must be added to this tray (by illuminating the "Add Paper" lamp 43 on the control panel), and to stop the continued operation of the apparatus. The paper tray 151 is then removed from its compartment 31 by opening the doors 44, 45 in from of the trays, rotating the handle 75 to its horizontal position to lift the feed rollers 61 from the paper tray and rolling the paper tray fowards out of the compartment. When the paper tray has been filled with paper, it is returned to the compartment. The leaf spring 212 in the tray will be depressed by the weight of the paper in the tray, so that the shoe 214 will engage the plunger 215 and depress it by an amount dependent on the setting of the rear guide 154 of the tray. The microswitch 218 will be actuated by the enlarged portion 216 of the plunger whatever the setting of the rear guide 154, so that a signal will be sent to the machine logic to cause the Add Paper lamp 43 to be extinguished (assuming this tray is still selected by the tray selector switch 46).

When the tray 151 is returned to the compartment, the left hand rollers 175 engage the rails 176 and the link arm rollers roll on the floor 177 on the compartment 31, and the lug 184 on the underside of the tray 151 engages the locating device 179. When the lug 184 reaches the base of the recess 186, the spring loaded lug 193 will latch the lug 184 in the recess 186, and the lug 184 will depress the plunger 191 to actuate the microswitch 192. This microswitch 192 causes the machine logic to deactuate an alarm which indicates that the paper tray is not registered, and the machine logic will then allow the apparatus to continue feeding the sheets from the tray provided that there are no other abnormalities in the apparatus which have been sensed by the sensing devices for the machine logic. The paper feed rollers 61 are lowered onto the top sheet in the stack by moving the handle 75 to its downward position.

The logical circuitry of the apparatus causes energisation of the electromagnetic clutches 73, 99 and 133 according to the operation of the dials 54, 55, switch, 46, start and stop buttons 56, 57 and the microswitches 142, 143, 192 and 218. The logical circuitry is also responsive to the main copying machine 21, so that a sheet is only fed when the main copying machine is ready to receive it. This circuitry is of conventional form and is not specifically described or illustrated.

When the digit dials 54, 55 have been set to a non-zero figure, and the Start button 56 has been depressed, the machine logic will, if the main machine is ready, cause energization of the electromagnetic clutch 73 connected to the shaft of the feed rollers in the compartment corresponding to the position of the three-way switch 46 through the microswitches 192, 218 of that compartment in the tray locating device and paper sensing device. Therefore, provided the selected tray 151 is in the correct position and at least one sheet is present on the tray with the feed rollers 61 pressing down, the feed rollers 61 will be driven forward by the common drive chain 72 of the apparatus and the top sheet from the stack will enter the appropriate path between the baffle plates 91 and 92 opposite the compartment from which it started. The sheet will strike the lower plate which is inclined upwardly, so that the sheet will be guided upwards to the nip of the separator roller assembly facilitating the task of the separator roller assembly, since when two or more sheets are fed together, the upwards guiding will tend to cause the leading edge of the upper sheet to be in advance of the leading edges of the lower sheets.

The sheet will pass between the nip of the separator rollers 94, 102 and be guided by the baffle plates 125 between the nip of the drive rollers 131, 130 and out of the left hand side of the apparatus shown in FIG. 1. As the leading edge of the sheet emerges from the drive roller assembly, it will actuate the finger 144 of microswitch 142, which will cause the machine logic to de-energize the electromagnetic clutches 73, 99 of the separator roller assembly and the feed rollers of the appropriate feed path which had previously been energized. Although the sheet may still be present under the feed rollers and between the rollers of the separator roller assembly, the drive will be taken over by the drive rollers alone, and the upper roller 94 of the separator roller assembly and the feed rollers 61 will over run by virtue of their over running clutches 101, 74. As the sheet progresses past the left hand side of the apparatus in FIG. 3 it enters the main copying machine 21. The main copying machine 21 intended for use with the apparatus illustrated operates at a slower sheet feed speed than the present apparatus, and a correspondingly slower drive is applied to the roller 131 of the drive roller assembly through the sprocket 136 and over running clutch 135 described above. When the electromagnetic clutch 133 is energized, the shaft 132 over runs the sprocket 136 so that the slower speed drive is ineffective. A sheet sensing device (not shown) is provided at the entry to the main copying machine 21, which is connected to the machine logic of the present apparatus to cause the electromagnetic clutch 133 to be de-energized when a sheet enters the main machine.

The drive of the roller 131 is then taken over by the slower speed drive through the clutch 136 and the sheet is fed into the main copying machine 21 at the speed at which the main copying machine is designed to operate. The same sheet sensing device in the main copying machine 21 is used in conjunction with a timer in the machine logic for operation of the paper jam alarm 42. Depression of the start button 56 carries the timer to start, and operation of the sheet sensing device resets the timer. If the timer is not reset after the normal time taken for a sheet to travel through the apparatus, the timer will cause the paper jam lamp 42 to light and the apparatus to shut down.

Since the speed of feed of the sheets through the present apparatus decreases as the leading edge of the sheet enters the main copying machine, it is important that the next sheet from the stack is not fed forward immediately the trailing edge of the first sheet passes under the feed rollers. It is for this reason that the microswitch 142 is connected to the machine logic to deenergize the electromagnetic clutch of the feed rollers until the trailing edge of the first sheet has passed the finger 144 of the microswitch 142. This will avoid the next sheet colliding with the trailing edge of the first sheet and possibly causing a paper jam in the apparatus.

For short sheets, such as may be fed from the top compartment, it is possible that the trailing edge of the short sheet may pass from below the feed rollers before the leading edge reaches the finger of the microswitch 142. For this reason the second microswitch 143 is provided with its finger 145 adjacent the nip of the separator rolls 94, 102 in the upper sheet feed path, the microswitch 143 being connected in the circuit to the electromagnetic clutch 73 of the feed rollers of the upper compartment in order to stop the feed rollers as soon as the leading edge of the sheet emerges from the nip of the separator roller assembly. Without this provision, the feed rollers would continue to rotate, thus feeding a second sheet immediately following the first sheet, possibly causing a paper jam. The drive of the sheet in the upper feed path then continues through the rollers 94 on the shaft 95 until the leading edge of the sheet reaches the microswitch 142, when the microswitch 142 de-energizes the electromagnetic clutch 99 and the drive is continued through the roller 131 as described above. The microswitch 143 causes the feed rollers 61 to be raised off the paper in the top compartment only in the tray as described above in order to prevent excessive wear on the separator rollers 94 which might occur if the rollers 94 had the added load caused by the overrunning of the feed rollers 61 no longer driven through clutch 73.

If two or more sheets should be fed forward by the feed rollers 61 in spite of the separating action of the snubbers 161 at the front corners of the stack, the separator rollers 94, 102 are designed to feed forward only the top sheet and to retain the second and any further sheets from proceeding beyond the separator rollers. The knurled texture of the polyurethane covering of the rollers 94 and 102 and the bias exerted by the spring 116 to urge the rollers together is such that when no sheet or only one sheet is present between the rollers 94 and 102, the lower roller 102 is urged to rotate anti-clockwise as seen in FIG. 3 by friction between the rollers and the sheet if present. However, when two or more sheets are present between the rollers, the torque exerted on the lower roller 102 by the friction between the plurality of sheets present between the rollers is insufficient to cause the slip clutch 121 to slip. The lower roller 102 and the sheet or sheets immediately adjacent to it therefore remain stationary, and only the sheet immediately adjacent the top roller 94 proceeds forward. As soon as this forwarded sheet reaches the finger 144 of microswitch 142, the drive to the roller 94 will be stopped so that the remaining sheet or sheets will remain between the separator roller assembly. The drive to the roller 94 will be continued after the trailing edge of the first sheet has passed the finger 144 of microswitch 142 and when the main copying machine 21 sends a signal to the machine logic that a further sheet is to be fed so that the sheet immediately adjacent to the roller 94 will be forwarded, and any remaining sheets will be retained as previously described. In the lower two compartments, the sheets retained at the separator roller assembly are long enough to extend under the feed rollers 61, so that when the separator rollers and the feed rollers are restarted when the machine 21 is ready after the trailing edge of the first sheet has passed the finger 144 of microswitch 142, no further sheets will be fed forward from the stack until all the multiply fed sheets have been cleared from the separator roller assembly. In the top feed path, the provision of microswitch 143 will prevent any further forwarding of sheets from the top of the stack by the feed rollers 61 in the top compartment.

The biasing arrangement of the spring 116 on the lower roller 102 allows the lower roller to move away from the upper roller 94 when a larger thickness of sheets passes between them. If this movement were not allowed, the reaction between the two rollers 94, 102 might increase on passage of multiple sheets to such an extent that the friction between adjacent sheets of the multiply fed sheets would be sufficient to exceed the macimum torque exerted by the slip clutch 121, so that sheets would then be fed forward together past the drive roller 121 and into the main copying machine 21 thus causing a paper jam.

When a paper jam is indicated by the lamp 142 on the control panel, the machine will shut down and cannot be restarted before depressing a button 241 on the side plate 88 of the apparatus shown in FIG. 1. This button 241 is connected to a two-unit solenoid device (not shown) in the machine logic, such that the solenoid must be re-set by depressing the button 241 each time a jam is indicated before the machine can be restarted. In order to gain access to this button 241, the operator will have to open the door (not shown) in front of the plate 88, and will then be able to view the space on both sides of the separator rollers 94, 102. If the paper jam is visible on the left hand side of the separator rollers, the appropriate baffles 125 can be removed by sliding them forward through the aperture 127 in order to gain access to the jammed sheets and to remove them. The baffle plates 125 are then replaced, the button 241 depressed and the cabinet door closed before starting the apparatus again. If the jammed paper is seen to the right of the separator roller assemblies, the appropriate paper tray 151 will have to be withdrawn from its compartment 31 in order to gain access to the space between the baffle plate pairs 91 and 92. Thus, it is not possible for the operator merely to press the start button 56 again when the machine has shut down after a paper jam, but the cabinet door in front of the apparatus shown in FIG. 1 must first be opened to depress the button 241 which will make the possible places in which a jam might occur visible and so the jam is more likely to be cleared even by a careless operator.

The apparatus illustrated in the drawings has been designed to operate with sheets of sufficient length to reach from the feed rollers 61 to the drive roller 131 in the centre and bottom sheet feed paths, and from the feed rollers 61 to the separator roller 94 in the upper path. Where it was convenient to design a machine with greater separation between the various rollers, it would be possible to position the microswitches 142 and 143 upstream of their present positions in order to stop the feed rollers 61 and possibly lift them from the top of the stack before the trailing edge of the top sheet passed below them, and to provide additional sheet transport devices to continue the transport of the sheets to the separator and drive rollers.

What we claim is:

1. A sheet feeding device comprising:

a plurality of support surfaces each for supporting a stack of sheets;

a sheet separating device for each support surface, the sheet separating device comprising a shaft, a plurality of first rollers mounted on the shaft symmetrically about the center of the shaft, a plurality of second rollers mounted opposite the first rollers for rotation about an axis substantially parallel to the shaft, means for supporting the shaft for movement towards and away from the axis, means acting on the center of the shaft for biasing the shaft toward the axis, and means for driving one of the plurality of rollers to forward a sheet between the nip of the roller;

means for each support surface for feeding the top sheet of the stack to the corresponding sheet separating device;

a single sheet conveyor;

guide means for guiding sheets from all the sheet separating devices to the single sheet conveyor; and, sheet sensing means located downstream of the single sheet conveyor for stopping operation of the sheet separating device and the sheet forwarding device of one of the support surfaces during passage of a sheet past the sheet sensing means.

2. A sheet feeding device as claimed in claim 1 including drive means for driving the first plurality of rollers in a forward feeding direction, a slip clutch having two members which will slip relative to each other when a torque greater than a predetermined value is applied between them, means for restraining one member of the slip clutch against rotation, the other member being connected for rotation with the plurality of second rollers.

* * * * *